US007757843B2

(12) United States Patent
Katsis

(10) Patent No.: US 7,757,843 B2
(45) Date of Patent: Jul. 20, 2010

(54) CHILDPROOF PACKAGE HAVING PAIRS OF LATCH ARRANGEMENTS

(76) Inventor: Nick Katsis, 105 St. David Street, Thornbury, Victoria 3071 (AU)

( * ) Notice: Subject to any disclaimer, the term of this patent is extended or adjusted under 35 U.S.C. 154(b) by 786 days.

(21) Appl. No.: 11/568,147

(22) PCT Filed: Apr. 18, 2005

(86) PCT No.: PCT/AU2005/000547

§ 371 (c)(1),
(2), (4) Date: Nov. 30, 2006

(87) PCT Pub. No.: WO2005/102849

PCT Pub. Date: Nov. 3, 2005

(65) Prior Publication Data

US 2009/0152134 A1 Jun. 18, 2009

(30) Foreign Application Priority Data

Apr. 20, 2004 (AU) ..... 2004902110

(51) Int. Cl.
*A45C 13/12* (2006.01)
*B65D 83/04* (2006.01)
*B65D 43/12* (2006.01)
*B65D 5/38* (2006.01)

(52) U.S. Cl. ..... 206/1.5; 206/38; 206/540; 220/345.3; 229/125.125

(58) Field of Classification Search ..... 206/1.5, 206/38–38.1, 96, 105–106, 121, 531–532, 206/540, 807; 220/345.1–345.3; 229/125.125
See application file for complete search history.

(56) References Cited

U.S. PATENT DOCUMENTS

| | | | | |
|---|---|---|---|---|
| 3,888,350 | A | 6/1975 | Horvath | |
| 4,076,117 | A * | 2/1978 | Wisdom et al. | 206/106 |
| 4,113,098 | A * | 9/1978 | Howard | 206/540 |
| 4,126,224 | A | 11/1978 | Laauwe et al. | |
| 4,401,210 | A * | 8/1983 | Anjou | 206/1.5 |
| 4,485,915 | A * | 12/1984 | Berghahn | 206/1.5 |
| 4,561,544 | A * | 12/1985 | Reeve | 206/540 |
| 4,844,284 | A * | 7/1989 | Drozd et al. | 206/1.5 |
| 5,275,291 | A * | 1/1994 | Sledge | 206/531 |
| 6,976,576 | B2 * | 12/2005 | Intini | 206/1.5 |
| 7,275,642 | B2 * | 10/2007 | Yuhara | 206/1.5 |
| 2002/0056652 | A1 | 5/2002 | Kawamura et al. | |

FOREIGN PATENT DOCUMENTS

| | | |
|---|---|---|
| WO | WO 01/55001 | 8/2001 |

* cited by examiner

*Primary Examiner*—Bryon P Gehman
(74) *Attorney, Agent, or Firm*—Fish & Richardson P.C.

(57) ABSTRACT

Childproof packaging for a product such as matches or pharmaceutical tablets includes a sleeve and a container for the product within the sleeve. The package includes two pairs of latches, with each latch of a pair oppositely located on the package. A user must use both hands simultaneously, with a respective hand operating a respective pair of latches, to hold the latches in an unlatched condition and also simultaneously to apply pressure to the container to slide it outwardly relatively to the sleeve. Such a two-handed, five finger operation to open the package requires a dexterity that is easy for adults but very difficult for children. Each latch may be a spring arm mounted tab or button which seats in an aperture in the sleeve.

15 Claims, 3 Drawing Sheets

CHILDPROOF PACKAGE HAVING PAIRS OF LATCH ARRANGEMENTS

TECHNICAL FIELD

The present invention relates to a package for childproof containment of a product. The product may be matches (or a box thereof) for lighting fires, pharmaceutical or health care substances such as various pills or tablets, or any other packageable product that is considered to be dangerous to children if they gain free or unsupervised access to the product. The term "childproof" means that the package is made very difficult for a child but not for an adult to open.

BACKGROUND

The discussion below of the background to the invention is included to explain the context of the invention. This is not to be taken as an admission that any of the matter referred to was in Australia published, known or part of the common general knowledge as at the priority date of any of the claims.

Packages for products of a nature that are dangerous to children may be childproofed in various ways. One way of childproofing a package is to provide it with a dexterity threshold for opening that is beyond a child's capabilities. A problem with this approach, however, is that if the dexterity level is made too high, the package may become too difficult even for an adult to open, or may become sufficiently difficult as not to be acceptable to adult consumers which could cause consequential loss of market share, notwithstanding the high level of childproofing that is provided.

The present invention seeks to provide a childproof package that has a high dexterity threshold and yet remains quite easy for an adult to open.

DISCLOSURE OF THE INVENTION

According to the invention there is provided a package for childproof containment of a product, the package including a sleeve, a container for the product within the sleeve, the container being slidable outwardly relative to the sleeve for accessing a product within the container, the container and the sleeve including a plurality of latch arrangements for preventing the relative sliding of the container and the sleeve unless the latch arrangements are held in an unlatched condition, the plurality of latch arrangements being so located and of such number as to require use of both hands of a user to simultaneously hold the latch arrangements in an unlatched condition and also simultaneously to apply pressure to the container to slide it outwardly relative to the sleeve for gaining access to a product within the container.

Preferably each latch arrangement comprises a biased tab or button on the container which, in the latched condition, seats within an aperture in the sleeve. Such an arrangement can be unlatched by pushing on the tab or button against its bias to hold it clear of the aperture such that the container is then able to be relatively slid outwardly of the sleeve.

Preferably individual latch arrangements are paired by being located generally opposite each other on the package whereby each of a pair can be held in an unlatched condition with one hand by contacting one latch arrangement of a pair with the thumb and the other latch arrangement of the pair with a finger and squeezing. With the provision of two such pairs of latch arrangements having biased tabs or buttons according to an embodiment of the invention, two hands are required to simultaneously hold the four latch arrangements in an unlatched condition whereby the container is freed for sliding relative to the sleeve. Whilst the latch arrangements are so held unlatched, a free finger of one hand may be used to apply pressure to an end of the container adjacent an open end of the sleeve to slide the container outwardly of the sleeve.

A package according to embodiments of the invention has a high dexterity threshold in that a user needs to use both of his/her hands to condition the package ready for opening (that is, to hold the plurality of latch arrangements in an unlatched condition) and must then apply a further force, for example by pushing with a free finger of one hand, to slide the inner container outwardly of its sleeve. Generally therefore, two actions are required, namely a squeezing action using the thumb and for example middle finger of each hand and then, whilst maintaining the squeezing force, a pushing action using for example the forefinger of one hand. These actions using both hands of a user would be very difficult for a child to perform and yet quite easy for an adult to perform. Thus the invention provides a high dexterity threshold and thus improved childproofing without unduly increasing the difficulty of opening for an adult.

The provision of a sleeve within which the container normally resides is an important feature because it ensures an increased level of child proofing compared to prior art childproof packages which typically comprise a container that is closed by a cover or a lid. Ensuring a close sliding fit of the container within the sleeve limits accessibility to the container via a prising implement when the container is latched within the sleeve in any attempt to avoid or overcome the childproof latch arrangements. In contrast, in prior art childproof packages, generally the container is accessible around much of the periphery of the cover or lid which allows a possibility that the cover or lid may be able to be prised off the container. Furthermore, the invention possesses the advantage that even if access between the sleeve and the container is gained in a tampering attempt, the sleeve and container can be separated only by sliding one out of the other, that is, the separability directions are much more limited than in the prior art. Also the latch arrangements according to an embodiment of the invention may be biased and shaped such as to present a tortuous path to any insertion of a prising implement between the sleeve and the container thereby preventing unlatching by the implement.

For a better understanding of the invention and to show how the same may be performed, preferred embodiments thereof will now be described, by way of non-limiting example, with reference to the accompanying drawings.

DESCRIPTION OF PREFERRED EMBODIMENTS

Figure 1:
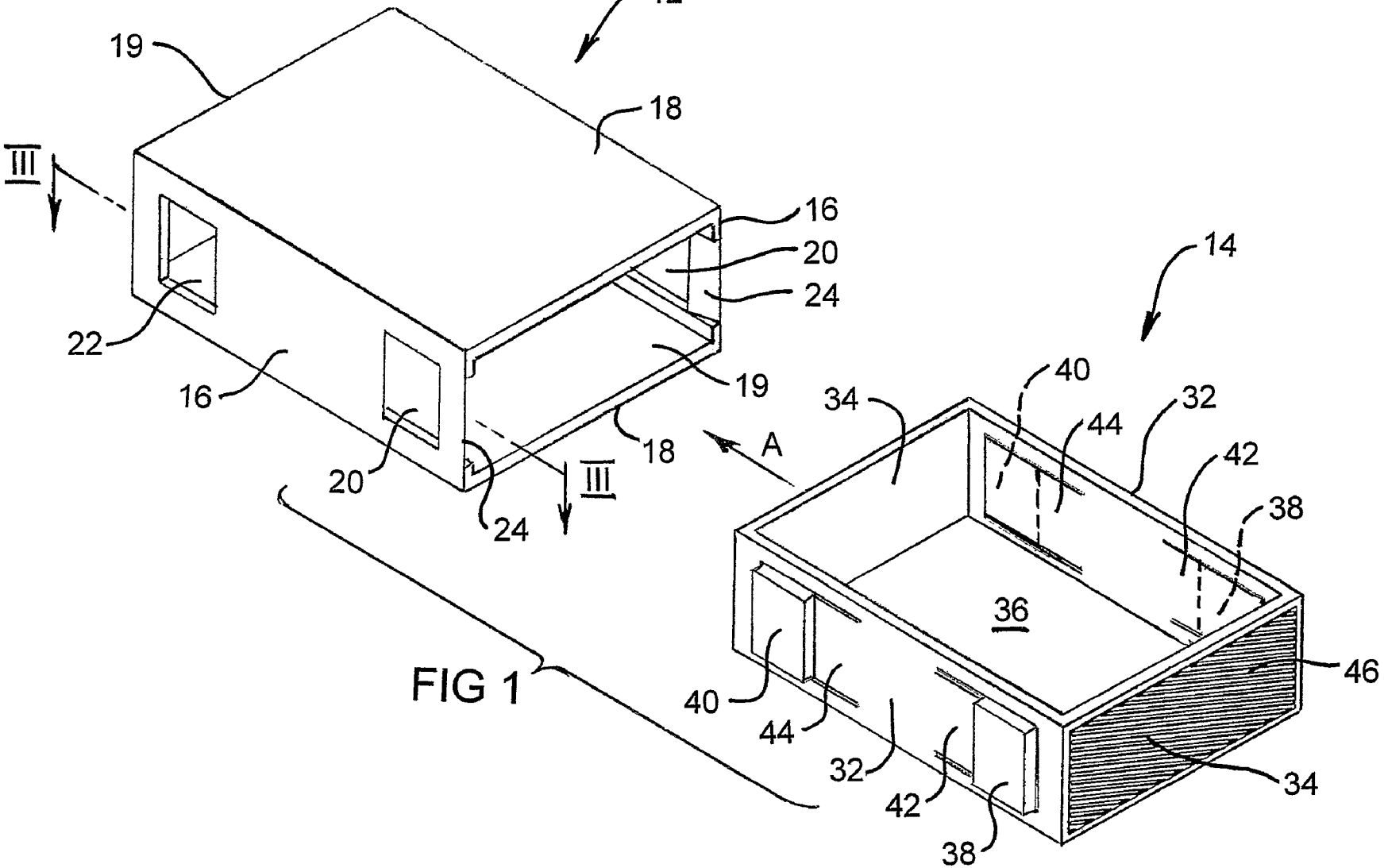
FIG. 1 is an isometric view of a sleeve and of a separated container of a first preferred embodiment of a package according to the invention.

A package 10 (see FIG. 2) according to the first preferred embodiment of the present invention is a box for the childproof containment of matches. The package or match box 10 includes a sleeve 12 and a container 14 (see FIG. 1).

The sleeve 12 is of rectangular parallelepiped shape having opposite side walls 16 and opposite top and bottom (as orientated in FIG. 1) walls 18 which define open ends 19. Each side wall 16 includes two apertures 20, 22 with the opposite apertures 20 forming a first pair and the opposite apertures 22 a second pair. Each aperture 20 has a ramp surface 24 (see FIGS. 1 and 3) of the same width as the aperture, which leads to the aperture 20 from an open end 19. Another ramp surface 26 leads from each aperture 20 to the inside surface of wall 16. Each aperture 22 also has ramp surfaces 28, 30 associated with it (see FIG. 3) similar to the ramp surfaces 24, 26 associated with apertures 20. The purpose and functioning of ramp surfaces 24, 26, 28 and 30 will be described hereinbelow.

The container 14 (see FIG. 1) is an open topped box having side walls 32, end walls 34 and a bottom wall 36 (as orientated in FIG. 1). It is sized to be a freely sliding fit within and is the same length as the sleeve 12. Each side wall 32 is formed such that it contains two buttons 38, 40 carried by a spring arm, respectively 42, 44. The material from which the container is formed is such that the arms 42, 44 are resilient and thereby provide a bias that acts to return the buttons 38, 40 to their normal position (seen in FIG. 1) against an inwards pressing force applied to the buttons 38, 40. The buttons 38, 40 are shaped and sized such that they are a snug fit within the apertures 20, 22 of sleeve 12. An end 34 of the container 14 may have a match-strike pad 46 thereon.

Each spring arm 42 (or 44)-button 38 (or 40)-aperture 20 (or 22) is a latch arrangement.

When container 14 is slid into sleeve 12 through an open end 19 (for example as orientated in FIG. 1 and indicated by arrow A) the buttons 40 ride over ramp surfaces 24 and then over ramp surfaces 26 of apertures 20 until they enter the apertures 22, at which point the buttons 38 enter the apertures 20 over ramp surfaces 24. Effectively the ramp surfaces 24 (then 26 and 30) define a channel for the buttons 40, 38 for guiding the sliding of container 14 into sleeve 12. Likewise, if the container 14 is assembled with sleeve 12 from the other end 19, the ramp surfaces 28 (then 30 and 26) effectively define a channel to assist the sliding of container 14 into sleeve 12. Thus the container 14 and the sleeve 12 include a plurality, namely four, latch arrangements which are arranged in the two pairs 20-38-42 and 22-40-44. These prevent relative sliding of the container 14 outwardly of the sleeve 12 unless all four latch arrangements are simultaneously held in an unlatched condition.

To unlatch the latch arrangements, all four buttons 38, 40 need to be depressed simultaneously using the thumb and for example the middle finger of each hand, that is, one hand is required to depress the button pair 38 and the other hand to depress the button pair 40. The forefinger of one hand can then be used to push on an end wall 34 of container 14 to slide it outwardly relative to the sleeve 12 and thereby gain access to the contents, for example matches, within the container 14. It will be appreciated that the level of dexterity needed to open the package 10 involving both hands and five fingers is beyond the capability of children who should not have unsupervised access to matches. Thus the package 10 provides a high degree of childproofing yet remains relatively easy for an adult to open.

The dexterity threshold for opening the package 10 could be further increased by sizing the package as to require a hand span capability for opening that is beyond what a child could accomplish, for example by having a quite wide package such that the span between the buttons of a pair can only be met by an adult.

Figure 2:
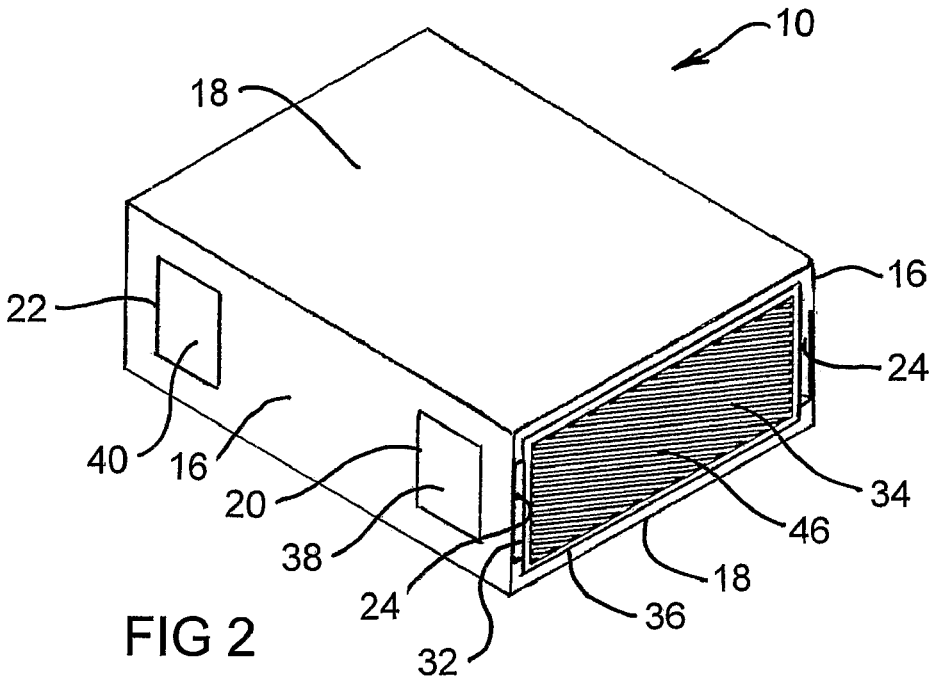
FIG. 2 shows the sleeve and the container of FIG. 1 assembled to form the first preferred embodiment of a package according to the invention.
Figure 3:
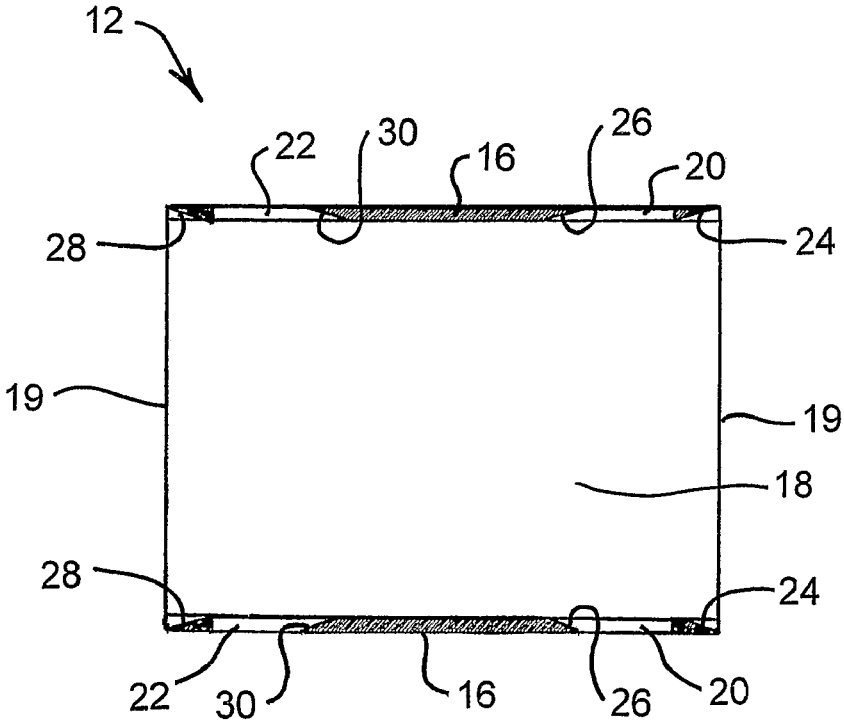
FIG. 3 is a section view on plane III-III of FIG. 1.

The embodiment of FIGS. 1 to 3 advantageously allows for opening of the package 10 by sliding the container 14 outwardly of either end 19 of the sleeve 12. Another advantage of the latch arrangement is that whichever direction the container 14 is slid outwardly of the sleeve 12, the pair of the button-spring arm combinations of the "second" pair of latch arrangements will engage within the apertures of the "first" pair of latch arrangements, for example, with reference to FIG. 1 as container 14 is slid outwardly of sleeve 12 in a direction opposite to arrow A, the buttons 40 on spring arms 44 will eventually engage within the apertures 20, thereby latching the container 14 to sleeve 12 in a partially opened position. To completely open or remove the container 14, the buttons 40 must be unlatched from the apertures 20, that is, a second unlatching operation must be performed. Clearly, for this advantage to be realised, all of the four latch arrangements need to be substantially identical in shape and size.

The container 14 and sleeve 12 may be made from any suitable material, for example a plastics material or a paper or cardboard product (which may be coated or otherwise treated to provide adequate resilience for spring arms 42, 44 as may be necessary). The container 14 and sleeve 12 may be made from the same or different materials.

Another advantage of the package 10 is that it provides a high level of security against tampering in addition to its childproofing. The package 10 can be made such that it is virtually impossible to insert a levering or prising implement in between the sleeve 12 and container 14 from an end 19 of the sleeve 12 in any attempt by a child to avoid or overcome the latch arrangements 20-38-42 and 22-40-44. Even if such an implement could be inserted between a side wall 16 of sleeve 12 and an adjacent side wall 32 of container 14 to manipulate the latch arrangements, this would not allow opening because the latch arrangements on the other side would remain latched. It would furthermore be highly difficult for a prising implement inserted between the side walls 16 and 32 to manipulate a latch arrangement given the tortuous path presented by the edge of a button 38 or 40 when the spring arms 42 and 44 are directed towards the ends 34 of the container 14 (as illustrated by FIG. 1).

Various modifications are possible. For example the package may have shapes that are other than rectangular parallelepiped, for example cylindrical, or shapes that are elliptical or obround in cross-section are within the scope of the invention. Also products other than matches, for example pharmaceutical tablets or capsules, may be contained by the container. The package may also constitute an outer packaging for a product that has its own packaging, for example with the above described first preferred embodiment, the container 14 could contain a box or book of matches as such instead of loose matches. Furthermore the container component of the invention may be a container merely in the sense that it contains a product, for example it could be a blister pack for tablets or capsules and the latch arrangements may include biased tabs (as distinct from buttons) which are formed on both sides of such a pack (such tabs having a generally planar configuration in the plane of the backing sheet of the pack). Thus it is to be understood that descriptions hereinbefore of a product "within" the container is intended to encompass blister pack type containers, that is, substantially panel shaped containers that contain individually packaged items of a product.

Figure 4:
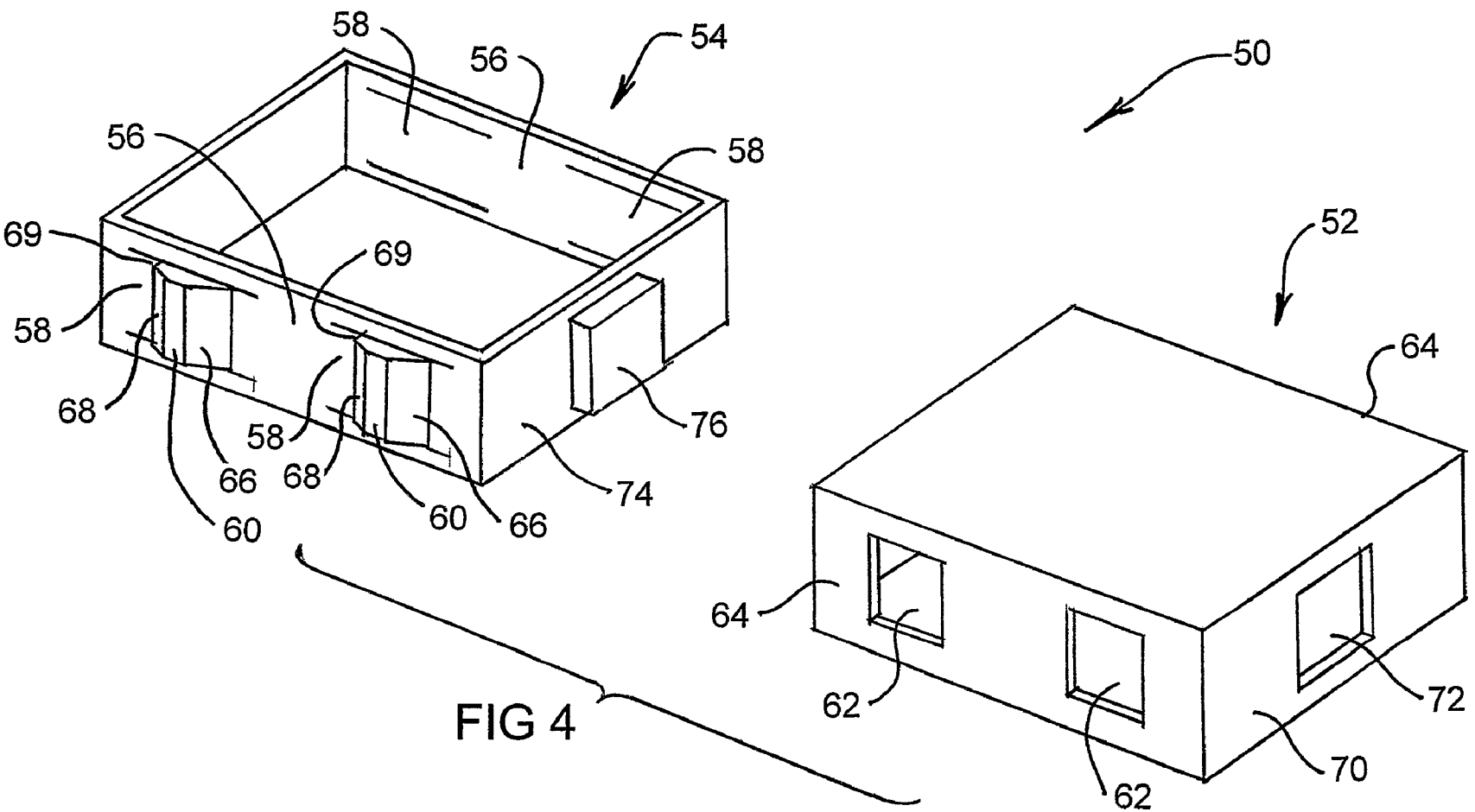
FIG. 4 is an isometric view of a sleeve and a separated container of a second preferred embodiment of a package according to the invention.

A package 50 according to a second embodiment of the invention, as shown in FIG. 4, is similar to the above described first embodiment in that both its container 54 and its sleeve 52 have a rectangular parallelepiped shape. The box-type container 54 includes opposite side walls 56 which are formed to have spring arms 58 that join to the side walls 56 at both ends thereof with a button 60 located generally centrally of each spring arm 58. The spring arms 58 of FIG. 4 provide a stronger and thus longer lasting alternative to the single end joining of spring arms 42 and 44 to the side walls 32 of the FIGS. 1 to 3 embodiment. The sleeve 52 includes apertures 62 within its side walls 64 for snugly seating the buttons 60 of the spring arms 58.

In the FIG. 4 embodiment ramp surfaces such as 24-26, 28-30 in the first embodiment leading to the apertures 62 are not provided. Instead the buttons 60 are formed to have a tapered leading and trailing edge, see references 66, 68, to facilitate the sliding assembly of the container 54 into the sleeve 52. The taper 68 on each button 60 does not extend to the spring arm 58, instead the taper 68 is such as to leave a small edge portion 69 which extends generally perpendicularly from the surface of the spring arm 58 on each button 60. Each edge portion 69 contacts the facing side edge of its aperture 62 to positively latch the container 54 in position within sleeve 52 when the buttons 60 are seated within the apertures 62.

Also sleeve 52 includes an end wall 70 which includes an opening 72 for finger access for pushing on an end wall 74 of the container 54 to slide it outwardly of the sleeve 52 whilst the four latch arrangements 58-60-62 are held in an unlatched condition. The end wall 74 of the container 54 may include a flat button-type projection 76 which fits snugly into the opening 72 for a person to apply finger pressure onto. The provision of the end wall 70 increases the level of child proofing because less area of the container 54 is accessible to apply pressure to slide the container 54 outwardly of the sleeve 52. Also the container 54 is openable only in a single direction. Also in this embodiment as with the first embodiment, the latch arrangements are such that upon sliding of container 54 out of sleeve 52, the "rear" buttons 60 will eventually engage within the "front" apertures 62 thereby latching the container 54 in a partially opened position relative to sleeve 52.

It is to be understood that the embodiment of FIGS. 1 to 3 may incorporate various features of the embodiment of FIG. 4 as alternatives (for example, the sleeve 12 may include an end wall having an opening or each spring arm 42, 44 may join to a side wall of the container 14 at both ends) and vice versa for incorporation of features of the FIGS. 1 to 3 embodiment with the FIG. 4 embodiment.

The invention described herein is susceptible to variations, modifications and/or additions other than those specifically described and it is to be understood that the invention includes all such variations, modifications and/or additions which fall within the scope of the following claims.

The invention claimed is:

1. A package for childproof containment of a product, the package including a sleeve, a container for a product within the sleeve, wherein the sleeve surrounds the container and has a shape that conforms with the shape of the container, the container being slidable outwardly relative to the sleeve for accessing a product within the container, the container and the sleeve including two pairs of latch arrangements for preventing the relative sliding of the container and the sleeve unless the latch arrangements are held in an unlatched condition, wherein each latch arrangement of a said pair is oppositely located on the package, wherein each latch arrangement of a said pair of the latch arrangements can be held in an unlatched condition using one hand, the two pairs of latch arrangements being so located and of such number as to require use of both hands of a user to simultaneously hold the latch arrangements in an unlatched condition and also simultaneously to apply pressure to the container to slide it outwardly relative to the sleeve for gaining access to a product within the container.

2. A package as claimed in claim 1 wherein each latch arrangement includes a biased button on the container which, in the latched condition, seats within an aperture in the sleeve.

3. A package as claimed in claim 2 wherein the container includes opposite sides each of which is formed to provide a spring arm for each latch arrangement for the bias of said button.

4. A package as claimed in claim 3 wherein each spring arm has a button formed thereon which seats within a complementary sized aperture in the sleeve.

5. A package as claimed in claim 4 wherein each spring arm has opposite ends and joins a said side at each of said ends, and the button on each spring arm is located between said ends.

6. A package as claimed in claim 4 wherein each spring arm has opposite ends and joins a said side at one of said ends, and the button on each spring arm is located at the other end.

7. A package as claimed in claim 1 wherein the sleeve includes an end wall which includes an opening for finger access for pushing on an end of the container to slide it outwardly of the sleeve.

8. A package as claimed in claim 1 wherein the container and the sleeve have a rectangular parallelepiped shape whereby both the container and the sleeve have opposite side walls.

9. A package as claimed in claim 8 wherein the sleeve includes apertures in its opposite side walls for receiving, respectively, biased buttons on the container, wherein a leading and a trailing edge of each button is tapered to facilitate the sliding assembly of the container within the sleeve.

10. A package as claimed in claim 1 wherein each latch arrangement includes a biased button on the container which, in the latched condition, seats within an aperture in the sleeve.

11. A package for childproof containment of a product, the package including a sleeve, a container for a product within the sleeve, the container being slidable outwardly relative to the sleeve for accessing a product within the container, the container and the sleeve including a plurality of latch arrangements for preventing the relative sliding of the container and the sleeve unless the latch arrangements are held in an unlatched condition, wherein the container includes opposite sides and each latch arrangement comprises a spring arm on a respective side and a button on the spring arm which, in the latched condition seats within an aperture in the sleeve, wherein each spring arm has opposite ends and joins a said side at each of said ends, and the button on each spring arm is located between said ends, the plurality of latch arrangements being so located and of such number as to require use of both hands of a user to simultaneously hold the latch arrangements in an unlatched condition and also simultaneously to apply pressure to the container to slide it outwardly relative to the sleeve for gaining access to a product within the container.

12. A package as claimed in claim 11 including two pairs of latch arrangements with each latch arrangement of a pair being generally oppositely located on the package, wherein each latch arrangement of a pair of the latch arrangements can be held in an unlatched condition using one hand.

13. A package for childproof containment of a product, the package including a sleeve, a container for a product within the sleeve, wherein the container and the sleeve have a rectangular parallelepiped shape whereby both the container and the sleeve have opposite side walls, the container being slidable outwardly relative to the sleeve for accessing a product within the container, the container and the sleeve including a plurality of latch arrangements for preventing the relative sliding of the container and the sleeve unless the latch arrangements are held in an unlatched condition, wherein each latch arrangement comprises a biased button on a respective said side wall of the container which is receivable within a respective aperture in a said side wall of the sleeve, the plurality of latch arrangements being so located and of such number as to require use of both hands of a user to simultaneously to apply pressure to the container to slide it outwardly relative to the sleeve for gaining access to a product within the container, wherein a ramp surface leads to each aperture from an open end of the sleeve, each ramp surface having a width the same as the aperture to thereby define a channel for a biased button for guiding the sliding of the container into the sleeve.

14. A package as claimed in claim 13 wherein each side wall of the container is formed to provide a spring arm for each latch arrangement wherein the button of each latch arrangement is located on a said spring arm which provides the bias to the button.

15. A package as claimed in claim 13 including two pairs of latch arrangements with each latch arrangement of a pair being generally oppositely located on the package, wherein each latch arrangement of a pair of the latch arrangements can be held in an unlatched condition using one hand.

* * * * *

UNITED STATES PATENT AND TRADEMARK OFFICE

CERTIFICATE OF CORRECTION

PATENT NO. : 7,757,843 B2
APPLICATION NO. : 11/568147
DATED : July 20, 2010
INVENTOR(S) : Nick Katsis It is certified that error appears in the above-identified patent and that said Letters Patent is hereby corrected as shown below:

Title Page (54) and Col. 1
Title, please delete "CHILDPROOF PACKAGE HAVING PAIRS OF LATCH ARRANGEMENT" and insert -- CHILDPROOF PACKAGE --.

Signed and Sealed this

Ninth Day of November, 2010

David J. Kappos

David J. Kappos
*Director of the United States Patent and Trademark Office*